United States Patent [19]

Barber

[11] Patent Number: 4,523,776

[45] Date of Patent: Jun. 18, 1985

[54] METHOD OF ADDING COLOR CODED LABELS TO FILES

[75] Inventor: Donald T. Barber, Toronto, Canada

[73] Assignee: Datafile Limited, Willowdale, Canada

[21] Appl. No.: 276,939

[22] Filed: Jun. 24, 1981

[51] Int. Cl.[3] ..... B42F 21/06

[52] U.S. Cl. ..... 283/39; 156/216; 283/81

[58] Field of Search ..... 156/216, 300, 301, 542; 283/21, 29, 81, 39

[56] References Cited

U.S. PATENT DOCUMENTS

| | | | |
|---|---|---|---|
| 2,507,659 | 5/1950 | Zalkind | 40/23 |
| 2,797,801 | 7/1957 | Bishop | 206/56 |
| 2,893,144 | 7/1959 | Cunningham | 40/23 |
| 3,444,635 | 5/1969 | Setzler | 40/2 |
| 3,586,160 | 6/1971 | Heimann | 206/56 AB |
| 3,691,662 | 9/1972 | Cunningham | 40/23 A |
| 3,747,242 | 7/1973 | Heimann | 40/2 R |
| 3,801,408 | 4/1974 | Kuring et al. | 156/552 |
| 3,805,426 | 4/1974 | Cunningham | 40/2 R |
| 4,204,639 | 5/1980 | Barber et al. | 235/462 |
| 4,240,848 | 12/1980 | Barber | 156/64 |
| 4,329,191 | 5/1982 | Barber | 156/64 |

FOREIGN PATENT DOCUMENTS

| | | |
|---|---|---|
| 0001167 | 3/1979 | European Pat. Off. . |
| 891985 | 10/1953 | Fed. Rep. of Germany . |
| 1239366 | 7/1960 | France . |
| 141053 | 9/1930 | Switzerland . |

*Primary Examiner*—Paul A. Bell

[57] ABSTRACT

A method for adding a reinforced labelled tab to a folder edge of a file folder of a file system is disclosed. The tab is prepared by applying a plurality of labels to a carrier web which has a pressure sensitive adhesive backing covered by a removable protective strip. A transparent reinforcing high tensile strength film is bonded to the carrier web and over the labels. A tab extension member is added to an edge of a file folder by use of the carrier web. The extension member is approximately the same thickness as the folder edge and the carrier web is of a width more than twice the width of the extension member so as to be securable to the spaced sides along the folder edge. The protective strip is removed and the carrier web applied to both of the folder sides with the extension member secured between folded opposing adhesive portions of the web to provide a unitary labelled tab on a folder.

3 Claims, 9 Drawing Figures

FIG.3.
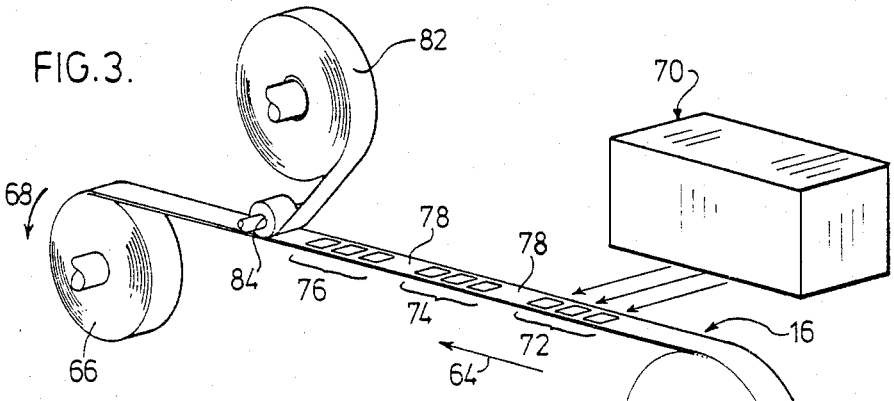
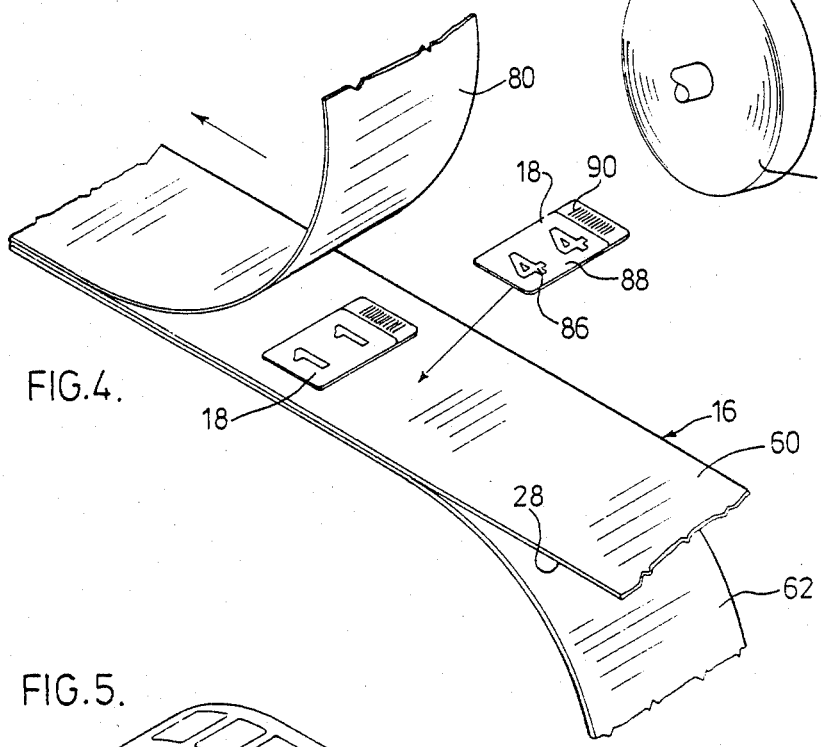
FIG.4.
FIG.5.
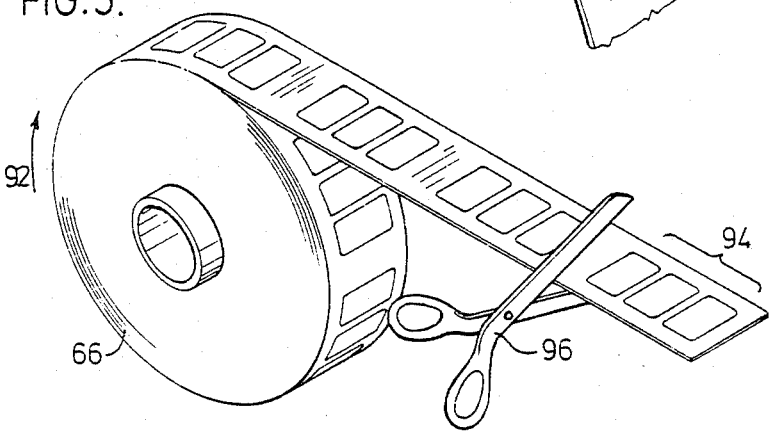

METHOD OF ADDING COLOR CODED LABELS TO FILES

FIELD OF THE INVENTION

This invention relates to a method of adding a labelled tab to a folder edge of a file of a file system and to a file with such add-on tab.

BACKGROUND OF THE INVENTION

It is common to add a tab to a file edge to provide a new code for the file, a colour coded arrangement for the file or to add machine readable data to a file. There are commercially available simple add-on tabs which permit the application of a code or name to a file folder such as disclosed in Heimann U.S. Pat. No. 3,747,242 or Turner, U.S. Pat. No. 4,201,403. These forms of add-on tabs are servicable; however, they are very flimsy and can add to the thickness of the file folder and in some situations may be readily torn from the file folder.

Another example of a more rigid add-on tab for a file folder is disclosed in Barber et al U.S. Pat. No. 4,204,639. This type of add-on tab, although of somewhat stronger construction than other add-on tabs, substantially increases the thickness of the file folder and may still be ripped from the file folder due to a bending of the tab causing the tab where it abuts the folder edge to separate.

Cunningham Canadian Pat. No. 934,261 discloses an add-on tab for a file folder, however, with that arrangement individual tabs are applied to the folder edge. In a situation where a plurality of labels are required, individual tabs are applied and thus permit relative movement between the tabs resulting in the individual tabs being caught and damaged or torn from the folder edge. The tabs as produced each have the same subject matter thereon so that different rolls of such tabs are required to provide the necessary different types of indicia in forming a new code for a file folder.

The add-on tab and method for applying such add-on tab, according to this invention, provides an extension for a file which carries a plurality of labels unique to that file for identifying same, where such extension acts in a manner equivalent to an integral extension of the file.

SUMMARY OF THE INVENTION

The method, according to this invention, for adding a reinforced labelled tab to a file edge of a file system comprises applying a plurality of labels to a carrier web to designate at least in part a code peculiar to such file of the file system. The carrier web has a pressure sensitive adhesive backing covered by a removable protective strip. A transparent reinforcing film is bonded to the carrier web and over the labels to reinforce the labelled carrier web. The so-formed carrier web is used to add a tab extension member of a length equal to the length of the labelled carrier web along a file edge. The extension member is approximately the same thickness as the file edge. The carrier web is of a width more than twice the width of the extension member to overlap thereby the spaced sides along file edge. The reinforcing film is of sufficient width to overlap the sides and is equal to or less than the width of the carrier web. The protective strip is removed from the carrier web and applied to both of the file flap sides with the extension members secured between folded opposing adhesive portions of the carrier web. An edge of the extension member is held against the file edge to provide on such file of a file system a unique unitary labelled tab for the particular file.

The label arrangement, according to this invention, for use in connecting a tab extension member adjacent the file edge comprises a carrier web of a predetermined width and length. A series of discrete visually readable labels are affixed to the carrier web to designate at least in part the code of a particular file of a file system. A continuous length of reinforcing, transparent film is bonded to the carrier web and over the labels and is equal to or less than the width of the carrier web. The carrier web is of a predetermined length approximately equal to the length of and a predetermined width greater than twice the width of a tab extension member to be connected to the file edge by the carrier web, in accordance with the method. The predetermined length of the carrier web is approximately equal to the length of selected file edge to which a tab extension member is to be connected to provide an extension for the file which simulates the strength and flexibility properties of a similar file having an integral tab extension.

A file having such labelled add-on tab comprises a tab extension member of a thickness comparable to that of file edge and having parallel spaced-apart longitudinally extending edges. One of the extension member edges is secured adjacent the selected file edge by a folded carrier web of a length approximating that of the extension member. The carrier web is bonded to a first side of the file along the selected edge and bonded to both sides of the extension member with the carrier web extending around the free edge of the extension member and bonded to the second side of the file to secure the extension member edge adjacent the selected file edge. A series of discrete labels have been affixed to the carrier web to designate at least in part the particular code for the file and a transparent reinforcing film is bonded to the carrier web along its length and approximating its width and over the labels to reinforce the labelled carrier web to provide this unitary add-on labelled tab for the file.

BRIEF DESCRIPTION OF THE DRAWINGS

Preferred embodiments of the invention are shown in the drawings wherein:

FIG. 3 schematically illustrates the application of labels to carrier web and bonding of reinforcing film to the labelled carrier web;

FIG. 4 is a section of the carrier web showing application of labels thereto;

FIG. 5 demonstrates unrolling a labelled carrier web and severing labelled tabs from the roll;

DETAILED DESCRIPTION OF THE PREFERRED EMBODIMENTS

Figure 1:
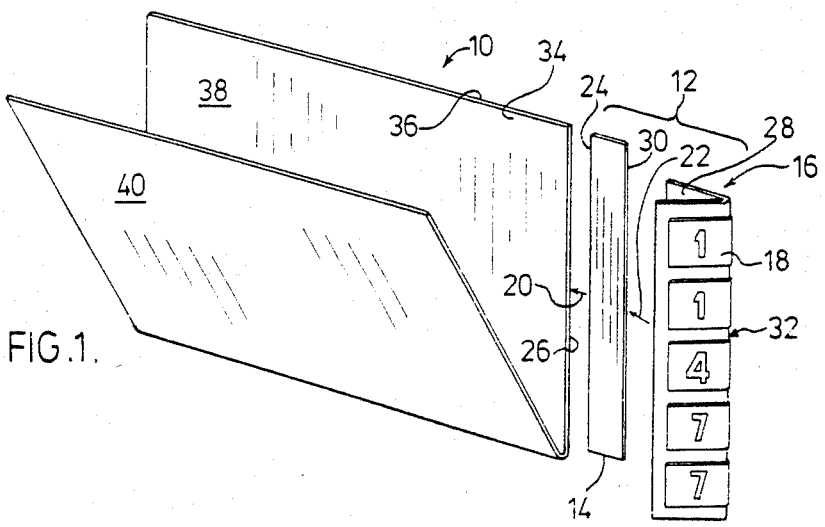
FIG. 1 is an exploded view of an add-on labelled tab for application to a file folder of a file system.

FIG. 1 shows a file 10 of a filing system. According to this embodiment, the file is in the form of a file folder having opposing flaps. Such file folders may have expandable portions at the hinge area for the flaps. Another type of file is a pocket expansion file which has expandable portions along both sides and bottom of the pocket. The pocket expansion file may be provided with a top flap to close the pocket. In the situation shown in FIG. 1, where it is desired to provide an add-on tab on a folder flap of the file folder for reasons of wanting, for example, to convert a file system to a colour coded system or to simply facilitate coding the files, the add-on tab generally designated 12 according to this invention may be used. The tab consists of a tab extension member 14 and a carrier 16 which is folded in the manner shown and has had previously applied thereto a plurality of labels 18 which may be the same or different. Although not shown, the carrier web 16 and labels 18 are covered by a reinforcing high tensile strength film. Figuratively the application of the add on tab 12 to the folder 10 is demonstrated by the arrows 20 and 22. An edge 24 of the tab extension member is placed against or abuts a file folder edge 26. The carrier web 16 has provided on its back face 28 a pressure sensitive adhesive. The tab extension 14 is placed against the folder edge 26 where the rear edge 30 of the tab extension fits against the inside of the creased or folded area generally designated at 32 of the labelled carrier web. The carrier web 16 is of sufficient width so as to overlap the sides 34 and 36 along the folder edge 26 such that when the carrier web 16 is affixed to the folder sides 34 and 36, the tab extension member 14 is held against the edge 26 of the folder 10. This arrangement provides a unitary extension tab member, which forms an extension for the folder flap having substantially the same structural characteristics as an integral tab extension for the same folder flap would have. When the add-on tab is bent, the connection is such to bend the folder flap as well and thereby avoid simply hinging the add-on tab at its point of connection to folder flap edge, which would weaken the add-on tab connection and could render useless the folder with add-on tab.

It is appeciated that the folder 10 of FIG. 1 is only representative and that other shapes and sizes of folders may be used, such as folders which are in the form of large envelopes or folders having three folder flap portions. The folder 10 as shown is of the more conventional type having flap portions 38 and 40 wherein this embodiment the tab extension 12 is added to the rear flap 38 so as to position machine readable code to be discussed hereafter, on the rear of the folder to facilitate machine reading of the code for the folder 10.

Figure 2:
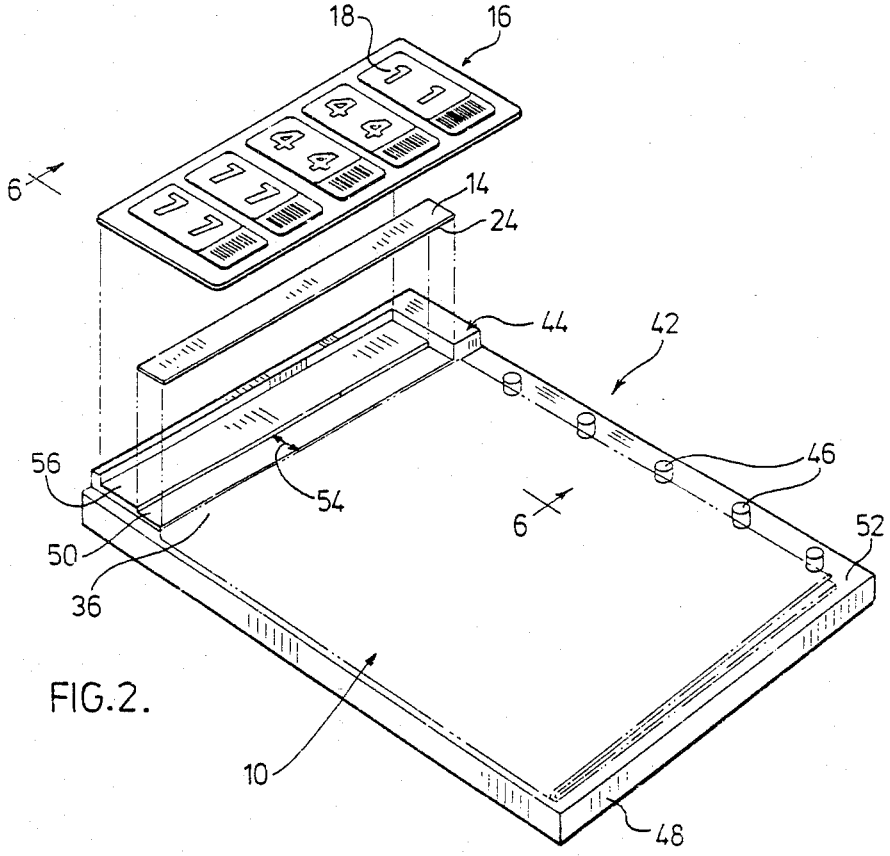
FIG. 2 is an isometric view of a template used in facilitating the application of the add-on tab to file folder.

To assist positioning the application of the add on tab to the folder 10, a template of the type shown in FIG. 2 may be used. The template generally designated 42 functions in a manner similar to that disclosed in Pfeffer, U.S. patent application Ser. No. 205,168 filed Nov. 12, 1980 and in Canadian patent application Ser. No. 367,396-1 filed Dec. 23, 1980 and entitled "Label Applying Template". The folder 10 is positioned on the template and is located relative to a label guide application device 44 by pegs 46 located on the board portion 48 of the template. The label application guide 44 includes a first step 50 which is at an elevation above the upper surface 52 of the board equal to the approximate combined thickness of the file folder flaps 38 and 40 of the folder 10. Positioned in the raised portion 50, is the tab extension member 14 where its width as indicated by arrow 54 is equal to the width of the tab extension member 14 so as to place edge 24 against the folder edge 26 so presented. A second ledge 56 is provided above the first ledge 54 where it is elevated above the first ledge 50 by a thickness slightly greater than the thickness of the tab extension member 14 as will be more fully discussed with regard to FIG. 6. The ledge 56 is made of a material to which the adhesive on the back 28 of the carrier web 16 will adhere, although it may be peeled from that surface 56 once the carrier web 16 is pressed onto the side 36 of the folder 10 across the tab extension member 14 to provide an assembly such as that shown in FIG. 7.

It is appreciated, however, that other approaches may be used in applying the tab extension 12 to the folder edge 26 such as by manually folding or creasing the carrier web 16 to provide a shape such as shown in FIG. 1. Subsequently the protective cover on the back of the carrier web 16 is removed to expose the adhesive material. The tab extension member 14 is then placed into the folded carrier web so as to locate its edge 30 against the creased area 32 on the inside thereof and affix it to one side of the folded carrier web. Then, the other edge 24 of the tab extension member 14 is placed against the edge 26 of the folder and the remainder of the folded portion of the carrier web is pressed against the rear face 36 of the folder flap 38. The remainder of the carrier web is pressed across and adhered to the face of the tab extension member 14 and pressed against side 34 of folder flap 38 to complete the addition of the tab to the file folder.

In order to make the labelled carrier web according to this invention, reference is made to FIGS. 3 and 4. In FIG. 3 there is schematically shown a roll 58 of carrier web stock where the carrier web 16 as shown in FIG. 4 is made up of web stock 60 with a protective strip 62 to protect the pressure sensitive adhesive on the underside 28 of the web stock 60. The carrier web is unrolled from roll 58 and is moved in the direction of arrow 64 to be eventually rerolled into roll 66 which is made up of labelled carrier web having a reinforcing film bonded to the carrier web and over the labels. The roll 66 may be driven in the direction of arrow 68 so as to pull the carrier stock web 16 through a labelling machine schematically shown at 70.

The labeller machine may be of the type disclosed in Barber et al, U.S. Pat. No. 4,183,779. As disclosed in this patent, the labeller is controlled so as to apply to a moving web a predetermined sequential series of labels where such series may be applied to the web in spaced apart groupings. As shown there are three different series of three labels in each group at 72, 74 and 76. It is understood that any number of labels may be applied to the carrier web for each series, such as five or seven labels per series in the manner shown in FIG. 1. Each label series is different to designate a particular code for each file of the file system to which the add-on tab is to be applied. The series of labels 72, 74 and 76 are spaced apart by the spaces 78. The labeller 70 may be programmed such that the space between each series of labels is consistent to facilitate the mechanical application of the labelled reinforced web to folders of a file system where the labelled reinforced carrier web stock is unrolled from roll 66.

To reinforce the carrier web with labels applied thereto to achieve the novel strength characteristics of the add-on tab, a reinforcing film is applied to the labelled surface of the carrier web 16. This film may be of the high tensile strength type, such as, a type of film sold under the trade mark "MYLAR" by DuPont and consists of polyethylene terephthalate. Such film may also be obtained from several other sources of supply such as "Celanar" (trademark) from Celanese, "Meliex" (trademark) from ICI Americas, "Terphane" (trademark) from Rhodia, "Scotchpar" (trademark) from 3M and "Sheldahl" (trademark) from Sheldahl. Such film of substantially thinner construction than the carrier web 16 when applied to the carrier web, unexpectedly increases the strength of the carrier web such that when used in securing a tab extension to a folder edge provides a tab extension which is quite rugged and has approximately the same strength characteristics of a comparable tab extension which is integral with a file folder flap.

As shown in FIG. 4, such reinforcing film 80 is applied to the labelled surface of the carrier web portion 60. A roll 82 of such film may be payed out and pressed against the carrier web surface by an application roller 84 which effects a bonding of the film 80 to the carrier web surface and over the applied labels because the underside of the film 18 has a pressure sensitive adhesive. For purposes of demonstrating the relationship of the film to the carrier web, labels 18 are positioned on the carrier web 16.

Thus it can be seen that the carrier web 16 has applied to its surface a plurality of labels where the code of the series of labels applied may be different from the next series as determined by the programme for the labeller 70. In preparing tabs for files of a file system the codes for all the files may be programmed into the labeller such that each series 72, 74, 76 etc. of labels reflects the particular code for each file to which the respective tab is to be applied to thereby distinguish that file from all other files in the system.

The labels 18 are of a width which is greater than one half the width of the carrier web 16 yet less than the entire width of the web. The label 18 according to this embodiment has two identical indicia provided thereon such as shown in FIG. 4. There are two identical indicium namely the numeral "4" and designated 86, which are spaced apart from one another and lie in a colour field designated 88 where the colour of that field is representative of the particular indicium "4". Off to one side of the colour field 88, a machine readable code 90 is provided and as shown, the machine readable code is the well known form of "bar code". Such type of label may be the same as that disclosed in the Barber et al, U.S. Pat. No. 4,204,639 which is used to provide a colour coded group of files where the colour coded indicia code is unique to each file and, in addition, the machine readable code on each label when applied to the carrier web and subsequently secured to a file folder provides a system whereby the code for each file may be machine read to facilitate computerized file room control of the file system.

As previously mentioned the series of labels on the carrier web may be severed from the roll 68 and mechanically applied to file folders. Such an approach is attractive where a file system contains many thousands of files to be converted to, for example, a machine readable colour coded filing system. However, in other situations where there are lesser files in the system or where it is desired to simply hand or manually apply the add-on tabs, an approach is shown in FIGS. 5 through 8. As shown in FIG. 5 the roll of labelled reinforced carrier web 66 is unrolled in the direction of arrow 92 and a series 94 of labels is severed by scissors 96 from the length of carrier web. Such cut portion of carrier web may be trimmed so as to match the length of the tab extension member 14 or conversely the tab extension member 14 may be trimmed to the severed or cut length of the carrier web 16 of FIG. 2. This method, therefore, provides an add-on tab having a plurality of labels which designate at least in part the code of a particular file of the file system. The labelled tab in consisting of a labelled carrier web, permits the making of an add-on tab which presents all labels designating the file folder code on a unitary structure. This avoids the problems of prior art devices where an individual tab for each file code indicium is required resulting in the applied tabs moving one relative to the other and increasing the chances of destroying or damaging such file add-on coded tabs. As shown in FIG. 1, the length of the add-on tab is approximately equal to the length dimension of folder flap edge 26. Thus when any portion of the add-on tab is bent during handling of the folder, the bending forces are distributed along the length of folder flap edge to lessen pressure points on the add-on tab connection and reduce thereby chances of damaging the connection.

Figure 6:
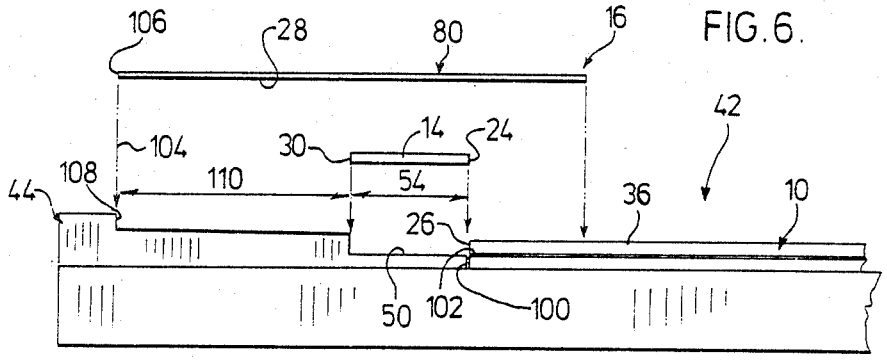
FIG. 6 is a section along the lines 6—6 of FIG. 2.

Referring to FIG. 6, the width of carrier web 16 having the labels applied thereto with the reinforcing film 80 bonded to the upper face thereof may be positioned over top of the label guide application device 44 of the template 42. With the file folder 10 positioned with its edge 26 adjacent a tab extension member 14 to be lowered on to the shelf area 50, the lower edge 100 of the folder abuts edge 102 of the label applicator guide 44 to properly position the edge of folder 10 so that when the tab extension member 14 is placed on ledge 50, its edge 24 abuts or is adjacent edge 26 of folder 10. This is determined by the width 54 of the shelf 50 which is approximately the same as the width of the tab extension member 14.

The shelf 56 is elevated above shelf 50 by a height which is slightly greater than the thickness of the tab extension member 14 to allow some tolerance to facilitate location and temporarily sticking of the carrier web 16 with its pressure sensitive adhesive backing 28 to the shelf 56. As explained in applicant's above noted pending application on this template, the shelf 56 may be formed of a material which releases the adhesive backing of the carrier web 16. Such material may be preferably "Teflon" (trademark). The sequence in adding the components of the add-on tab onto the label template 42 can be altered. For example, the folder 10 may be positioned on the template against guide pegs 46 and against edge 102 of the label guide 44 and then the tab extension member 14 positioned on shelf 50. Subsequently the carrier web 16 may be lowered in the direction of arrow 104 and pressed against face 56 where its edge 106 abuts edge 108 of the label guide so as to perfectly align the carrier web as labelled along the outer edge 30 of the extension member 14. The distance or width 110 of shelf 56 may vary depending upon the configuration for the add-on tab. According to this embodiment the width 110 is approximately one half the width of the carrier web 16. With edge 106 positioned, the carrier web is pressed onto shelf 56 and then pressed onto the back surface 36 of the folder 10 and across the tab extension member 14 to hold or locate the extension member edge 24 against edge 26 of the folder 10.

Figure 7:
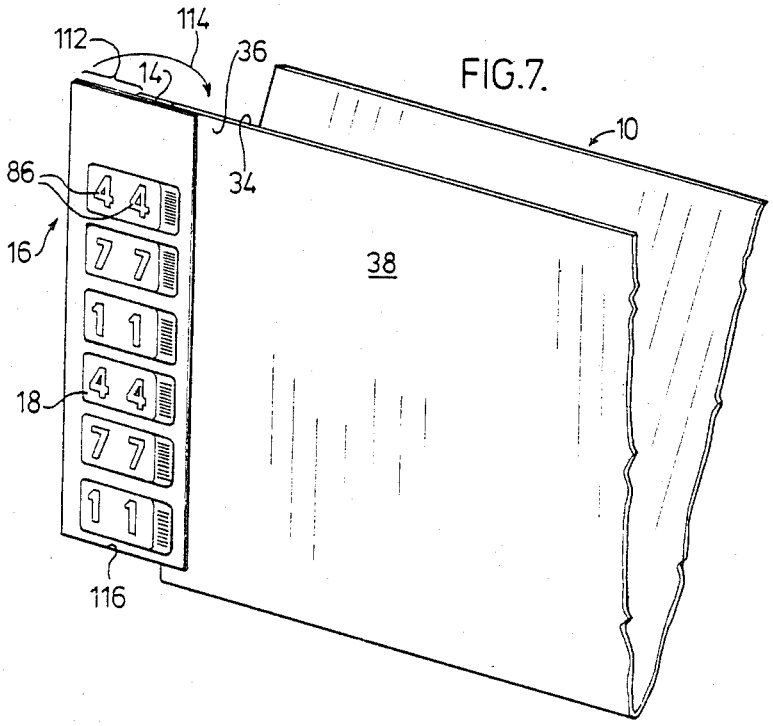
FIG. 7 shows the file folder removed from the template of FIG. 6 to demonstrate the remaining step in applying the tab to the folder.

The folder 10 may be removed from the template to provide an arrangement shown in FIG. 7 where the rear flap 38 of the folder 10 has one half of the carrier web 16 secured to rear face 36 and across face of extension member 14. The overall width of the carrier web is such to be greater than twice the width of the tab extension member 14 so as to overlap the side 36 and subsequently the inner side 34 of the flap 38 to the extent shown. This provides for a secure connection of the add-on tab to the folder edge.

Figure 8:
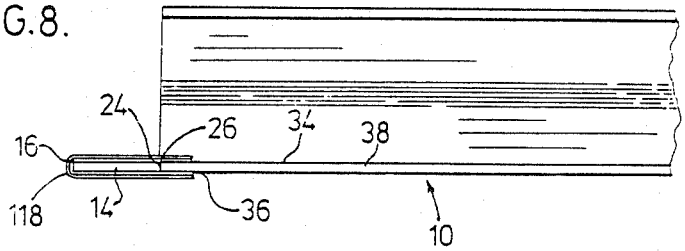
FIG. 8 is a top view of the folder with the tab added onto the folder edge.

The remainder of the carrier web as shown at 112 is moved in the direction of arrow 114 and pressed onto the remaining face of the extension member 14 and the inner side 34 of the flap 38. To complete the addition of the add-on tab to the folder as shown in FIG. 8, the folder 10 has the edge 24 of the tab extension member 14 held adjacent and in this instance abutting the edge 26 of the folder 10 where the carrier web as reinforced and having labels thereon is folded around and overlaps and is bonded to the faces 34 and 36 of the flap 38.

It can be seen that the additional thickness added to the folder edge is that of a thickness of the carrier web and the reinforcing film. It should be emphasized that in FIG. 8 the thickness has been enlarged for purposes of illustration however the thickness of the reinforcing film may be in the range of 0.5 mils up to 2 mils and the carrier web may be in the range of 3 mils up to 5 mils. There is little appreciable addition to the thickness of the folder edge in using such an add-on tab. However, there is a substantial increase in the rigidity of the add-on tab and added life to the add-on tab of the file folder as provide for in combination of the laminated layers for the add-on tab. As previously mentioned, it has been found that such combination of components provides an add-on tab which has the characteristics of a tab extension which is integral or part of a folder flap.

The selection of the material for the tab extension member 14 may be the same as the material in the folder flap 38 so that the tab extension member 14 is of approximately the same thickness as the folder flap 38.

The positioning of the labels 18 on the carrier web 16 is such that the colour field between the indicia 86 of each label 18 is approximately centered on the fold line for the carrier web as shown in dot at 116. The colour field of each label of the particular file folder tab is presented along the outer edge at 118 as shown in FIG. 8 for each add-on tab so as to provide a band of colours peculiar to each file folder. When all files are placed on a shelving system, an appropriate colour coding system for the filing arrangement is provided such as disclosed in the Barber et al, U.S. Pat. No. 4,204,639.

Regarding the use of the template 42 for applying the add-on tab to the folder, it is appreciated that alternative sequences may be used in applying the carrier web 16. For example, prior to locating of the folder and tab extension member 14 on the template, the web 16 may be affixed to shelf 56 with its edge 106 abutting guide edge 108. The tab extension member 54 may then be placed under the carrier web 16 because the shelf 56 is elevated above shelf 50 by a height greater than the thickness of the extension member 14. Subsequent to this, the file folder 10 may be inserted under the carrier web 16 with its lower edge 100 abutting edge 102 of the guide. This procedure enables positioning of the carrier web 16 on the label guide without concern for touching of the adhesive backing 28 of the carrier web against either the tab extension member 14 or the back face 36 of folder flap 38 while positioning the label. This is particularly advantageous in situations where the adhesive backing 28 has a very powerful adhesive attraction to the paper of the tab extension member and folder, so that a slight touching of the adhesive backing to the folder or tab extension member during a positioning of the label on the shelf 56 would result in a spoiled label, after removing the carrier web for repositioning on the shelf 56.

Figure 9:
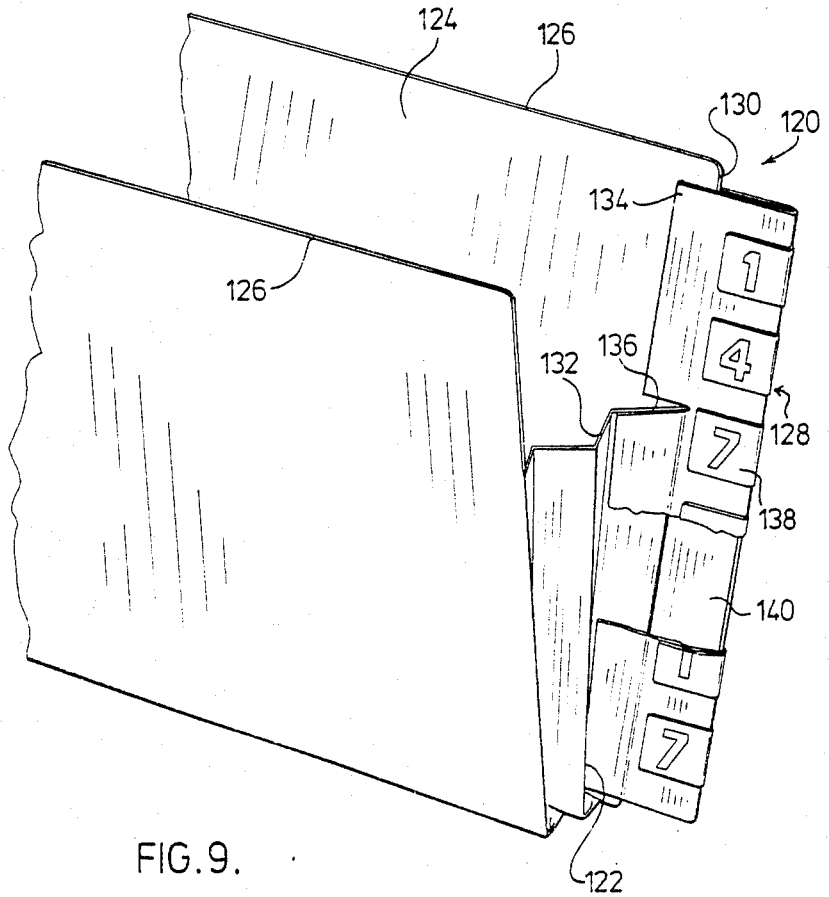
FIG. 9 is a perspective view of an end of an expansion pocket file having the add-on tab applied to an edge thereof.

Turning to FIG. 9, an expansion pocket file 120 is shown where an add-on tab according to this invention is applied thereto. The pocket file has expandable portions, such as at 122, along both sides and bottom to provide an open top 124. The expandable portions interconnect pocket opposing flaps 126. The add-on tab 128 is applied to the rear edge 130 of the file. The expandable portion 122 has a plurality of gussets 132 where the carrier web 134 of the add-on label arrangement is applied to the front and rear faces of flap 126 along edge 130. The carrier web is partially severed at 136 to permit gusset 132 adjacent edge 130 to move outwardly from flap 126 when the file is expanded.

The add-on tab is of the same construction as that shown in FIG. 1, where the colour coded labels 138 are affixed to the carrier web and covered by the reinforcing "Mylar" film. As shown in the cut-away area of the label arrangement, the tab extension member 140, which is of approximately the same thickness as edge 130, is secured adjacent the edge by carrier web 134 of the add-on tab construction. The flexibility of this coded-on tab is exemplified in its use on both file folders and pocket expansion files.

The method according to this invention provides an add-on tab which is superior in structural properties to known add-on tabs in view of its stiffer yet pliable characteristics. An aspect of the invention which contributes strength to the add-on tab is the addition of the "Mylar" film to the labelled surface of the carrier. As previously mention, "Mylar" is a thin film and may be as thin as 0.5 mils. The "Mylar" film width is no greater than the width of the carrier and to facilitate application of the "Mylar" film to the carrier web, it may be slightly less than the width of the carrier web to accommodate some misalignment in application of "Mylar" film to the labelled carrier web. The method also provides for the preparation of individual unique colour coded labelled add-on tabs which are machine readable for respective folders in a coded file system by using labels of the Barber et al U.S. Pat. No. 4,204,639.

Although various preferred embodiments of the invention have been described herein in detail, it will be appreciated by those skilled in the art that variations may be made thereto without departing from the spirit of the invention or the scope of the appended claims.

The embodiments of the invention in which an exclusive property or privilege is claimed are defined as follows:

1. In combination, an add-on tab and a file substrate having a straight edge to which said add-on tab is secured, said add-on tab comprising an elongate extension member in abutment with the straight edge of said file substrate and adhesively secured thereto by a carrier web having a thickness in the range of about 3 to 5 mils and of a length approximately equal to the length of said extension member, a plurality of discrete pre-printed labels on the upper surface of the said web with each label spaced in the length of the carrier web and collectively defining a colour code for identifying a code substantially peculiar to such substrate, a transparent high tensile strength reinforcing plastic film of a thickness in the range of about 0.5 to about 2 mils adhesively secured over said labels and said carrier web and extending the length of said carrier web, said carrier web and film being of a width greater than said extension member and being wrapped about said extension member and secured either side and about one edge of said extension member, said add-on tab being secured to said file substrate either side thereof by said carrier web and reinforcing film which bridge the junction of said extension member and said file substrate either side of said file substrate to provide a unitary add-on tab along an edge of said file substrate, said carrier web and said plastic film distributing localized loads applied to said tab along said tab and to said file substrate adjacent said straight edge.

2. An add-on tab as claimed in claim 1, wherein said file substrate is a file folder.

3. An add-on tab as claimed in claim 1, wherein said file substrate is a file folder having at least two opposed flap portions and said tab is secured to said file folder along a side edge thereof.

* * * * *